US011335315B2

(12) United States Patent
Nørholm

(10) Patent No.: US 11,335,315 B2
(45) Date of Patent: May 17, 2022

(54) WEARABLE ELECTRONIC DEVICE WITH LOW FREQUENCY NOISE REDUCTION

(71) Applicant: GN AUDIO A/S, Ballerup (DK)

(72) Inventor: Sidsel Marie Nørholm, Ballerup (DK)

(73) Assignee: GN Audio A/S, Ballerup (DK)

( * ) Notice: Subject to any disclaimer, the term of this patent is extended or adjusted under 35 U.S.C. 154(b) by 0 days.

(21) Appl. No.: 17/102,325

(22) Filed: Nov. 23, 2020

(65) Prior Publication Data

US 2021/0193104 A1 Jun. 24, 2021

(30) Foreign Application Priority Data

Dec. 20, 2019 (EP) ..... 19218704

(51) Int. Cl.
*G10K 11/16* (2006.01)
*G10K 11/178* (2006.01)
(Continued)

(52) U.S. Cl.
CPC .. *G10K 11/17854* (2018.01); *G10K 11/17875* (2018.01); *G10L 25/18* (2013.01);
(Continued)

(58) Field of Classification Search
CPC ..... G10K 11/17854; G10K 11/17875; G10K 2210/1081; G10K 2210/3026;
(Continued)

(56) References Cited

U.S. PATENT DOCUMENTS

2009/0097674 A1 4/2009 Watson et al.
2014/0185827 A1* 7/2014 Kitazawa ..... H04R 3/005 381/94.2

(Continued)

FOREIGN PATENT DOCUMENTS

EP 3267697 A1 1/2018
WO 0186639 A1 11/2001

OTHER PUBLICATIONS

The extended European search report issued in corresponding European Application No. 19218704.5, dated May 15, 2020, 5 pages provided.

*Primary Examiner* — Ammar T Hamid
(74) *Attorney, Agent, or Firm* — Hamre, Schumann, Mueller & Larson, P.C.

(57) ABSTRACT

A method at a wearable electronic device with: a first electro-acoustic input transducer and a second electro-acoustic input transducer arranged to pick up a first acoustic signal and convert the first acoustic signal to a first microphone signal and second microphone signal; and a third electro-acoustic input transducer arranged to pick up a second acoustic signal and convert the second acoustic signal to a third microphone signal; and a processor (140). The method comprises: generating a beamformed signal based on the first microphone signal (x1) and the second microphone signal; estimating a first frequency value representing a fundamental frequency in one or more of: the first microphone signal, the second microphone signal and the third microphone signal; configuring a first filter with one or more passbands at one or more integer multiples of the first frequency value and one or more stop bands adjacent the one or more stop bands; and filtering, using the first filter, one or more of: the first microphone signal, the second microphone signal and the beamformed signal.

15 Claims, 5 Drawing Sheets

(51) Int. Cl.

| | |
|---|---|
| ***G10L 25/18*** | (2013.01) |
| ***G10L 25/78*** | (2013.01) |
| ***H04R 1/40*** | (2006.01) |
| ***H04R 3/00*** | (2006.01) |
| ***H04R 3/04*** | (2006.01) |

(52) U.S. Cl.
CPC ..... *G10L 25/78* (2013.01); *H04R 1/406* (2013.01); *H04R 3/005* (2013.01); *H04R 3/04* (2013.01); *G10K 2210/1081* (2013.01); *G10K 2210/3026* (2013.01); *G10K 2210/3028* (2013.01)

(58) Field of Classification Search
CPC . G10K 2210/3028; G10L 25/18; G10L 25/78; H04R 1/406; H04R 3/005; H04R 3/04
USPC ..... 381/71.6, 71.11
See application file for complete search history.

(56) References Cited

U.S. PATENT DOCUMENTS

| | | | | |
|---|---|---|---|---|
| 2016/0073203 | A1* | 3/2016 | Kuriger | H04R 25/43 381/23.1 |
| 2020/0107137 | A1* | 4/2020 | Koutrouli | H04R 25/604 |

* cited by examiner

WEARABLE ELECTRONIC DEVICE WITH LOW FREQUENCY NOISE REDUCTION

A wearable electronic device, such as a headset for telecommunication with a remote electronic device, may comprise a pair of small loudspeakers sitting in earpieces worn by a wearer in different ways depending on the configuration of the headset. The wearer may be a user of the wearable electronic device.

The headset picks up an acoustic signal comprising the wearer's speech by means of a first electro-acoustic input transducer, e.g. a microphone, for transmission to a remote electronic device and emits an acoustic signal by means of an electro-acoustic output transducer, e.g. a small loudspeaker, representing a signal transmitted from the remote electronic device.

The headset may have a first mode in which it operates as a headset for telecommunication. The headset may also have a second mode in which it operates as headphones or earphones to enable a wearer to listen to an audio source privately, in contrast to a conventional loudspeaker, which emits sound into the open air for anyone nearby to hear. Headphones or earphones may connect to an audio source for playback of audio.

The headset may be configured as headphones or earphones which comprise a pair of small loudspeakers sitting in earpieces worn by a wearer (a user of the wearable electronic device) in different ways depending on the configuration of the headphones or earphones. Earphones are usually placed at least partially in the wearer's ear canals and headphones are usually worn by a headband or neckband with the earpieces resting on or over the wearer's ears.

At least when operating as a headset, it is a general problem that not only the wearer's speech, but also acoustic (noise) signals from the greater ambient space around the wearer is picked up by the microphones and transmitted to the remote electronic device. Therefore, headsets are configured with spatial filtering, e.g. using beamforming and/or directional microphones, to acoustically focus on the wearer's mouth. Unfortunately, beamformers require frequency equalization to compensate for an inherent low frequency roll-off due to the beamforming technique. This frequency equalization in turn requires large gains at low frequencies—and thus degrades the signal-to-noise ratio especially at low frequencies.

SUMMARY

Beamforming, at least beamforming of audio signals, may require a high gain at low frequencies to compensate for a suppressed low frequency response of a beamformer. The suppressed low frequency response of the beamformer may be due to a small relative phase difference between microphone signals at low frequencies. However, by compensation or equalizing involving a high gain noise in the signals will be amplified.

Thus, there is provided a method comprising:

at a wearable electronic device with: a first electro-acoustic input transducer and a second electro-acoustic input transducer arranged to pick up a first acoustic signal and convert the first acoustic signal to a first microphone signal and a second microphone signal; and a third electro-acoustic input transducer arranged to pick up a second acoustic signal and convert the second acoustic signal to a third microphone signal; and a processor:

generating a beamformed signal based on the first microphone signal and the second microphone signal;

estimating a first frequency value representing a fundamental frequency in one or more of: the first microphone signal, the second microphone signal and the third microphone signal;

configuring a first filter with one or more first passbands, including an upper first passband, at one or more integer multiples of the first frequency value; and one or more first stop bands adjacent the one or more passbands; wherein the first filter has a second passband above the upper passband;

filtering, using the first filter, one or more of: the first microphone signal, the second microphone signal and the beamformed signal.

Thereby a voiced speech signal, which has harmonic frequencies, may be passed through the first filter, while noise signals at frequencies between or below the harmonic frequencies are suppressed. This improves the signal-to-noise ratio.

In some examples, estimating a first frequency value includes estimating a first frequency value on a recurring basis and the first filter is configured accordingly. The first filter is thereby tracking the fundamental frequency or the fundamental frequency and one or more harmonic frequencies. This enables that the filter adapts to the voice pitch of a person speaking and passes the voiced speech through the first filter.

Beamforming may involve a low frequency roll-off of the transfer function associated with beamforming as such. Beamforming thus often requires some type of frequency response equalization, including a significant gain compensation, especially at lower frequencies, to compensate for the low frequency roll-off of the transfer function associated with the beamforming. Conventionally, this equalization increases the noise level due to the high gain. However, since the claimed invention suppresses noise signals, in the one or more first stop bands, without cutting off voiced speech signals, the signal-to-noise ratio is comparatively improved.

In some examples the first passbands have a respective centre frequency at the at one or more integer multiples of the first frequency value. In some examples the first passbands respectively extends over the one or more integer multiples of the first frequency value, but are not centred about the one or more integer multiples of the first frequency value.

The first passbands may have narrow passbands as it is known in the art of audio band-pass filters.

The first passbands may be limited to be located at e.g. one, two, three or four harmonic frequencies including the fundamental frequency. Thus, the first passbands are located at lower frequencies whereas the second passband is located at higher frequencies. The second passband may be configured to pass a predefined audio band above the the upper passband.

In one example, the fundamental frequency may be 60 Hz and first passbands may be located at 60 Hz and 120 Hz for integer multiples of: 1 and 2. The second passband may thus extend from 120 Hz and upwards e.g. up to 20 KHz or lower or higher. The second passband may extend from frequencies above 120 Hz or below 120 Hz. Generally, the second passband is wider than the first passbands, including the upper first passband.

In some examples the first filter comprises a first filter section in parallel with a second filter section. The first filter section may be a high-pass filter with a lower cut-off frequency e.g. at about 120 Hz. The second section may comprise one or more parallel band-pass filters each located at a harmonic frequency. In some aspects the second filter section comprises a comb filter coupled in series with a low-pass filter. In some aspects the high-pass filter and the low-pass filter establish a substantially flat frequency response of the first filter.

In other examples the first filter comprises a series of filter sections each configured as band-stop filters (including band-reject filters and notch filters) with respective stop-bands located adjacent the one or more passbands.

In yet other examples the first filter comprises one or both of a feedback filter and a feed-forward filter.

The first filter may be implemented in a multitude of different ways, including the ways described herein in more detail.

In some examples the first filter has respective, substantially equal gains at the one or more pass bands. This may be expedient e.g. when beamforming includes frequency equalization.

In some embodiments the first electro-acoustic input transducer and the second electro-acoustic input transducer are arranged to pick up the first acoustic signal from an ambient space; and wherein the third electro-acoustic input transducer is arranged to pick up the second acoustic signal from an enclosed space different from the ambient space; and the first frequency value is estimated based on the third microphone signal.

Thereby the first frequency value may be more reliably and/or more accurately estimated. This, in turn increases the chance of passing a voiced speech signal through the first filter, since the first passbands can be more reliably and/or more accurately aligned with the harmonic frequencies of the voiced speech.

The third microphone signal may be better suited, than the first and second microphone signal, for estimating the first frequency value e.g. since the wearable electronic device may offer at least some passive dampening of noise in the ambient acoustic signal.

In some examples, the third electro-acoustic input transducer additionally serves another purpose e.g. as a feedback sensor in an active noise cancellation system at the wearable electronic device.

In some embodiments the method comprises:

detecting periods with presence of voiced speech and periods with absence of voiced speech in one or more of: the first microphone signal, the second microphone signal and the third microphone signal;

in accordance with detecting presence of voiced speech, estimating the first frequency value based on a period with presence of voiced speech.

Thereby, the chance of estimating the first frequency value as a fundamental frequency of a voiced speech component is increased. Also, the chance of having the one or more first passbands aligned with one or more harmonic frequencies, including the fundamental frequency, of the voiced speech is increased. Thus, the voiced speech signal is more likely passed thru, rather than suppressed.

In particular, when performing frequency spectrum equalization to compensate for a low-frequency roll-off of a beamforming process, the voiced speech signal is more likely passed thru, rather than suppressed. This is especially true at lower order harmonics of the voiced speech.

It should be noted that during periods detected as being absent of voice speech, speech, albeit unvoiced, may still be present e.g. in the form of unvoiced speech or sounds.

In some embodiments the method comprises:

detecting periods with presence of voiced speech and periods with absence of voiced speech in one or more of: the first microphone signal, the second microphone signal and the third microphone signal;

in accordance with detecting absence of voiced speech, reconfiguring the first filter, including dispensing with at least one of the one or more first stop bands.

Thereby, when voiced speech is not detected, the first filter can be reconfigured to dispense with at least one of the one or more first stop bands. Thereby the risk of introducing artefacts in the signal to be transmitted to a remote electronic device e.g. due to flawed estimation of the fundamental tone is reduced. The dispensing with at least one of the one or more first stop bands may include one or more of: deactivating the one or more first stop bands, deactivating or decouple a filter section of the first filter, implementing the one or more first stop bands or reconfiguring the first filter to a configuration not having at least one of the one or more first stop bands.

In some examples, in accordance with detecting presence of voiced speech, the method comprises reconfiguring the first filter, including activating at least one of the one or more first stop bands.

In some examples, wherein the first filter comprises a first filter section in parallel with a second filter section and wherein the second section may comprise one or more parallel band-pass filters each located at a harmonic frequency, the second filter section or selected band-pass filters thereof may be disengaged, at times when voiced speech is not detected.

In other examples, wherein the first filter comprises a series of filter sections each configured as band-stop filters, one or more of the filter sections may be by-passed, at times when voiced speech is not detected.

In yet other examples, wherein the first filter comprises one or both of a feedback filter and a feed-forward filter, the feedback or feed-forward loop may be opened, at times when voiced speech is not detected.

In some embodiments the second passband is implemented by a high-pass filter with a lower cut-off frequency; comprising:

detecting periods with presence of voiced speech and periods with absence of voiced speech in one or more of: the first microphone signal, the second microphone signal and the third microphone signal;

in accordance with determining absence of voiced speech, reconfiguring the first filter, including setting a lower cut-off frequency of the high-pass filter at a predetermined lower cut-off frequency value.

Thereby, lower cut-off frequency can be set in dependence on whether voiced speech is detected or not. This enables, lowering the lower cur-off frequency of the high-pass filter e.g. at times when dispensing with at least one of the one or more first stop bands. Thus, rather than suppressing a signal at times when voiced speech is not detected, setting a lower cut-off frequency of the high-pass filter at a predetermined lower cut-off frequency value, enables passing thru the signal.

The predetermined lower cut-off frequency value may effectively be set such that all frequencies are passed thru. In some examples, the lower cut-off frequency is set to a value in the range of 20-200 Hz.

In some embodiments the method comprises:

performing frequency spectrum equalization, using a second filter, to compensate for a low-frequency roll-off, of the beamformer.

Thereby, a desired frequency response can be obtained. In some examples a flat frequency is desired at least within a predefined audio band.

Frequency spectrum equalization may be performed by the second filter before, after or as a step of performing beamforming. The second filter may have a characteristic with a slope decreasing towards a corner frequency from lower frequencies. In some examples the slope is a −6 dB slope or a −12 dB slope. The second filter may have a low-shelf characteristic and/or a high-shelf characteristic. The second filter may be a fixed filter.

In some embodiments the first filter has respective gains at the one or more passbands at the one or more integer multiples of the first frequency value; wherein the respective gains compensate for a low frequency roll-off, of the beamformer.

Thereby the first filter is enabled to perform at least some frequency spectrum equalization. Thereby, it may be possible to dispense with a separate filter for equalization.

In some examples, the respective gains are computed as a function of a respective integer multiple of the first frequency value and a frequency characteristic of the beamformer.

In some embodiments the first filter comprises a comb filter.

The comb filter enables an efficient time-domain implementation in processing hardware. A comb filter is known to a person skilled in the art and is a filter implemented by adding a delayed version of a signal to itself, causing constructive and destructive interference. The frequency response of a comb filter consists of a series of regularly spaced notches. The comb filter may be implemented as a feed-forward comb filter or a feedback comb filter.

In some embodiments the upper first passband is located at a first integer multiple of the first frequency value; and the first integer multiple is determined based on one or both of: a predetermined integer value and a value based on one or more of: the first microphone signal, the second microphone signal and the third microphone signal.

Thereby, it is possible to pass thru all frequencies above a certain frequency e.g. at which the strength of harmonic components of the voiced speech has vanished or at which it is desired to pass all frequencies for other considerations.

In some embodiments the method comprises:

transmitting a signal which is based on the beamformed signal to a remote electronic device.

Thereby the signal can be received at the remote electronic device with an improved signal-to-noise ratio e.g. as described in connection with claim 1.

In some embodiments the method comprises:

a first electro-acoustic output transducer arranged to emit an acoustic signal at an enclosed space established by at least a portion of the wearable electronic device at a wearer's ear.

The first electro-acoustic output transducer may be a loudspeaker such as a miniature loudspeaker. In some examples the first electro-acoustic output transducer is arranged in an earcup of a headset or in an earbud of an earphone. The enclosed space may be established by at least a portion of the wearable electronic device at a wearer's ear.

In some embodiments the method comprises:

performing active noise cancellation based on a feedback signal, which is based on the third microphone signal; wherein an active noise cancellation signal is emitted by the first electro-mechanical output transducer.

Thereby the third electro-mechanical input transducer can serve a dual purpose, namely in connection with active noise cancellation and in connection with estimating the first frequency value.

In some embodiments the method comprises:

performing short term Fourier transform of one or more of: the first microphone signal, the second microphone signal, the third microphone signal, the first microphone signal when filtered using the first filter, the second microphone signal when filtered using the first filter; and performing inverse short term Fourier transform of a signal based on the beamformed signal;

wherein one or more of the first filtering, the second filtering, equalization and beamforming is performed in the frequency domain.

The short term Fourier transform generates frames, e.g. consecutive frames, of so-called time-frequency bins. Each frame may have a time span of about 30-40 milliseconds, e.g. 33 milliseconds. Consecutive frames may have a temporal overlap of 40-60% e.g. 50%. This means that speech activity can be reliably detected within about 100 milliseconds or within a shorter or longer period.

In some examples the first filter is implemented in a time-domain implementations, whereas one or more of beamforming and equalization is implemented in the frequency domain.

There is also provided a wearable electronic device comprising:

a first electro-acoustic input transducer and a second electro-acoustic input transducer arranged to pick up a first acoustic signal and convert the first acoustic signal to a first microphone signal and second microphone signal;

a third electro-acoustic input transducer arranged to pick up a second acoustic signal and convert the second acoustic signal to a third microphone signal; and a processor configured to perform the method according to any of the preceding claims.

The wearable device may be configured as a headset enabling communication with a remote party e.g. via a telephone, which may be a so-called softphone or another type of application running on an electronic device. A headset may use wireless communication e.g. in accordance with a Bluetooth or DECT compliant standard. The headset may be of a headphone type, to be worn on a wearer's head e.g. by means of a headband or to be worn around the wearer's neck e.g. by means of a neckband. The headset may alternatively be of the earphone type to be worn in the wearer's ears. Generally, headphones comprise earcups to sit over or on the wearer's ears and earphones comprise earbuds or earplugs to be inserted in the wearer's ears. Herein, earcups, earbuds or earplugs are designated earpieces.

The earpieces are generally configured to establish a space between the eardrum and the loudspeaker. The microphone may be arranged in the earpiece, as an inside microphone, to capture sound waves inside the space between the eardrum and the loudspeaker or in the earpiece, as an outside microphone, to capture sound waves impinging on the earpiece from the surroundings.

In some aspects the third electro-acoustic input transducer is arranged as an inside microphone and the first electro-acoustic input transducer and the second electro-acoustic input transducer are arranged as an outside microphone.

In some aspects the processor is integrated in body parts of the wearable device. The body parts may include one or more of: an earpiece, a headband, a neckband and other body parts of the wearable device. The processor may be configured as one or more components e.g. with a first component in a left side body part and a second component in a right side body part of the wearable device.

There is also provided a signal processing module for a headphone, an earphone or a headset; wherein the signal processing module is configured to perform the method according to any of the preceding claims.

The signal processing module may be a signal processor e.g. in the form of an integrated circuit or multiple integrated circuits arranged on one or more circuit boards or a portion thereof.

There is also provided a computer-readable medium comprising instructions for performing the method when run by a processor at a wearable electronic device comprising: an electro-acoustic input transducer arranged to pick up an acoustic signal and convert the acoustic signal to a microphone signal; and a loudspeaker.

The computer-readable medium may be a memory or a portion thereof of a signal processing module.

BRIEF DESCRIPTION OF THE FIGURES

A more detailed description follows below with reference to the drawing, in which.

DETAILED DESCRIPTION

Figure 1:
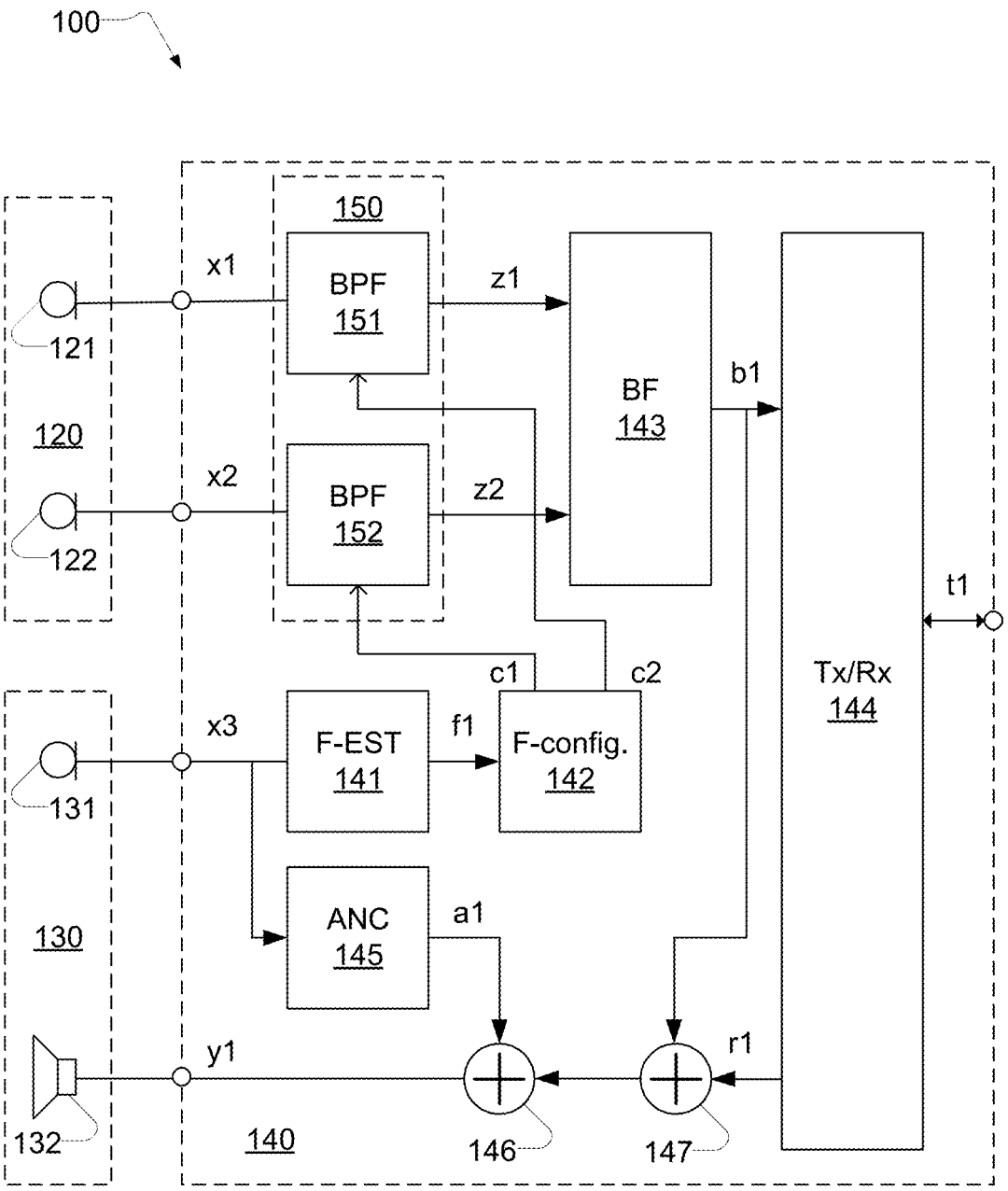
FIG. 1 shows a block diagram of a wearable electronic device with a processor in a first embodiment.

FIG. 1 shows a block diagram of a wearable electronic device with a processor in a first embodiment. The block diagram shows a wearable electronic device 100 with a first electro-acoustic input transducer 121 in the form of a first microphone and a second electro-acoustic input transducer 122 in the form of a second microphone. The microphones are arranged to pick up a first acoustic signal and convert the first acoustic signal to a first microphone signal, x1, and a second microphone signal, x2. The wearable electronic device also comprises a third electro-acoustic input transducer 131 in the form of a third microphone arranged to pick up a second acoustic signal and convert the second acoustic signal to a third microphone signal x3; a first electro-acoustical output transducer 132 in the form of a loudspeaker and a processor 140. The processor 140 may be comprised by a processing module. The processor 140 may be in communication with a remote electronic device (not shown) via a bi-directional port transmitting or receiving a communication signal t1 including, in an outgoing direction, a representation of the first acoustic signal. In an ingoing direction, the communication signal t1 may include a representation of a signal for being reproduced as an acoustic signal e.g. by means of the electro-acoustic output transducer 132.

The first electro-acoustic input transducer 121 and the second electro-acoustic input transducer 122 are commonly designated electro-acoustic transducer elements 120. The electro-acoustic transducer elements 120 may be arranged e.g. in a left side earpiece and a further electro-acoustic transducer element 120 may be arranged in a right side earpiece. The electro-acoustic transducer elements 120 may comprise one or more additional electro-acoustic input transducers e.g. arranged in an array.

The electro-acoustic output transducer 132 and the third electro-acoustic input transducer 131 are commonly designated electro-acoustic transducer elements 130. The electro-acoustic transducer elements 130 may be arranged e.g. in a left side earpiece and a further electro-acoustic transducer elements 130 may be arranged in a right side earpiece.

The processor 140 receives the first microphone signal x1 and the second microphone signal x2, which in some examples are digital microphone signals, and is configured to generate a beamformed signal b1 based on at least the first microphone signal x1 and the second microphone signal x2.

The processor 140 estimates, by a frequency estimator F-EST, 141, a first frequency value, f1, representing a fundamental frequency in the third microphone signal x3. In some examples the frequency estimator 141 alternatively or additionally receives one or more of: the first microphone signal (x1) and the second microphone signal (x2).

The first frequency value, f1, is received by a filter configurator F-config, 142 that configures a first filter 150 with:

- one or more first passbands including an upper first passband, at one or more integer multiples of the first frequency value, f1; and
- one or more first stop bands adjacent the one or more passbands.

This enables suppression of noise at other frequencies than at least at the fundamental frequency and at zero, one or more higher order harmonic frequencies. The filter configurator F-config, 142 may output signals c1 or c1 and c2 with a representation, e.g. filter coefficients, of the first filter or at least a portion thereof.

To also pass signals at higher frequencies, which may not relate to or be different from a particular harmonic frequencies, the first filter 150 also has a second passband above the upper first passband. Thus, above one, two, three or any number of harmonic frequencies, all frequencies can be passed. In some embodiments the number of first passbands is fixed and in other embodiments, the number of passbands is adjusted dynamically.

The first filter 150 performs the filtering of the first microphone signal, x1, and the second microphone signal, x2. In this example, the first filter comprises a first filter section 151 and a second filter section 152 filtering the first microphone signal, x1, and the second microphone signal, x2, respectively. The first filter section and the second filter section may be identical or different.

In some examples the first signal c1 is similar or identical to the second signal c2 or at least the first signal c1 and the second signal c2 represents the same set of filter coefficients. In some examples, as shown herein in connection with FIG. 2, the first filter may be arranged to filter the beamformed signal b1. The first filter may be implemented in many different ways, some of which are described herein. Some characteristics of the first filter are illustrated herein. A filtered first microphone signal, z1, and a filtered second microphone signal, z2, are output from the first filter 150 and input to beamformer 143, wherein beamforming based on the filtered microphone signals is performed.

The filter configurator F-config, 142 may operate on a recurring basis to adapt the first filter, e.g. by reconfiguration of the first filter, to a currently estimated fundamental frequency. Reconfiguration of the first filter may include updating filter coefficients of the first filter.

In some embodiments, the beamformed signal, b1, is transmitted to a remote electronic device via the transceiver 144. In some examples, the beamformed signal b1 or a signal based on the beamformed signal is sent to the electro-acoustic output transducer 132 e.g. to compensate for a hearing loss of the user of the wearable electronic device and/or to provide a so-called side-tone signal to the user of the wearable device as it is known in the art. In some examples, the beamformed signal, b1, or a signal based on the beamformed signal is mixed, by a first mixer 147, with a received signal, r1, from a remote electronic device via the transceiver 144. The mixer 147 may be an adder or a switch selecting either the beamformed signal or a signal based on the beamformed signal and the received signal, r1.

In some embodiments, active noise cancellation is performed by unit ANC, 145, which receives the microphone signal x3 and outputs an active noise cancellation signal, a1, which is provided as a feedback signal to the electro-acoustic output transducer 132 via a second mixer 146. The second mixer 146 mixes the signal al with a signal from the first adder or with one or both of: a received signal, r1, and the beamformed signal b1 or a signal based thereon.

Figure 2:
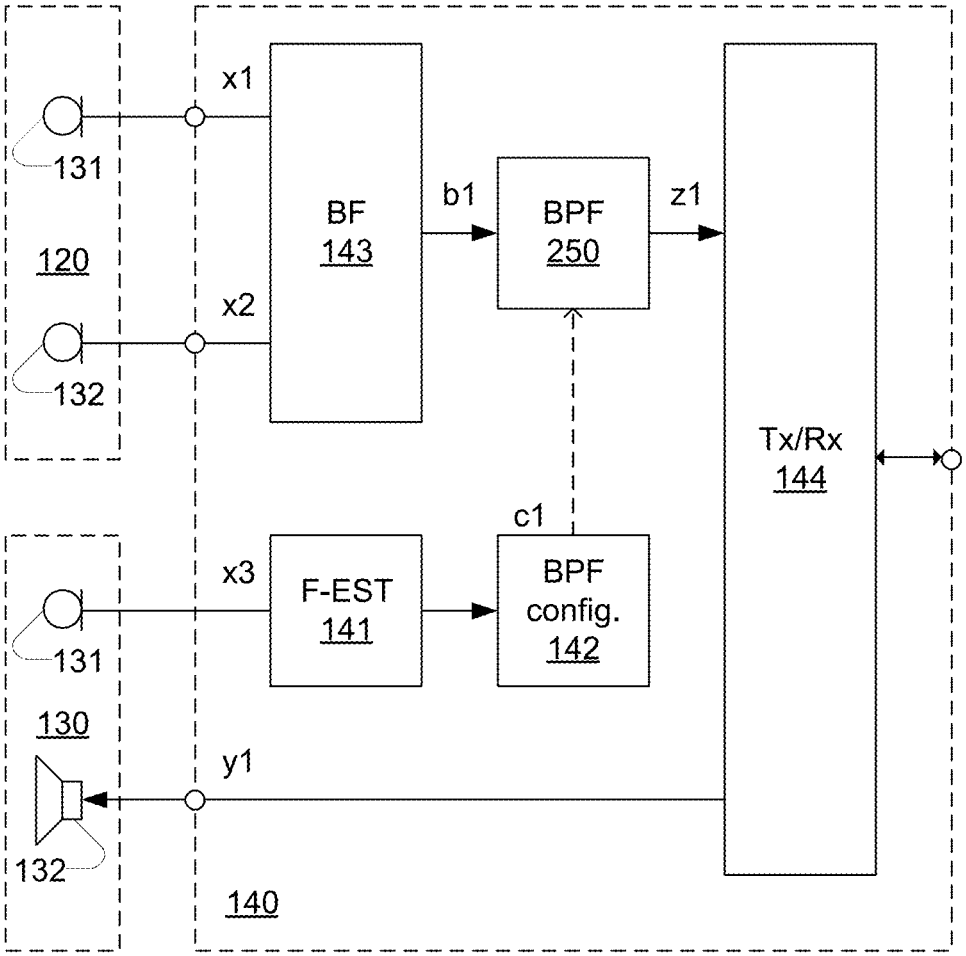
FIG. 2 shows a block diagram of a wearable electronic device with a processor in a second embodiment.

FIG. 2 shows a block diagram of a wearable electronic device with a processor in a second embodiment. In this second embodiment the first filter is designated by reference numeral 250 and is arranged to filter the beamformed signal, b1, and to provide a filtered signal, z1. On the one hand, an advantage of the second embodiment, compared to the first embodiment, is that the first filter, here designated by reference numeral 250, can be simpler since it may be sufficient to filter one channel, rather than two channels or more. On the other hand, an advantage of the first embodiment is that first filter suppresses noise before beamforming is performed. Thereby, noise suppressed microphone signals, rather than the microphone signals, are input to the beamformer 143.

It should be noted that the second embodiment may include one or more of the elements described in connection with the first configuration. For instance, the second embodiment may include elements related to one or more of: active noise cancellation, side-tone generation, and compensation for a hearing loss.

Figure 3:
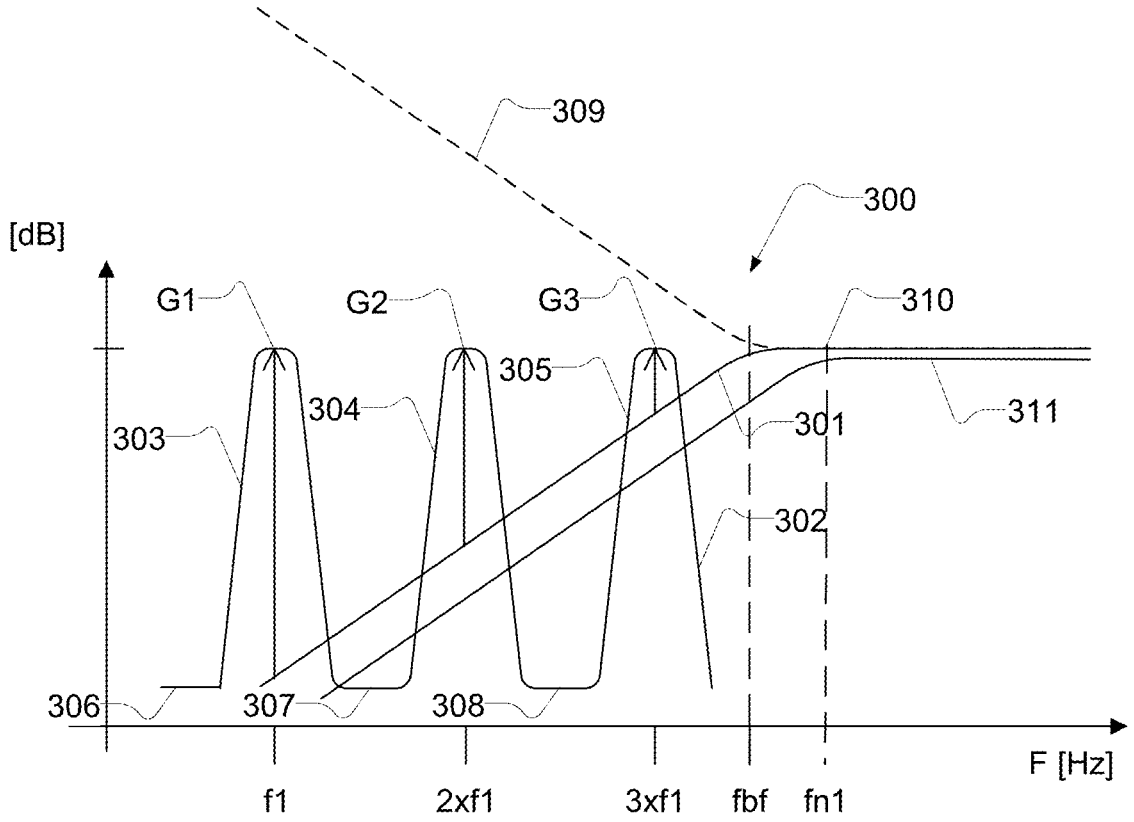
FIG. 3 shows a first example of an illustrative frequency gain characteristic.

FIG. 3 shows a first example of an illustrative frequency gain transfer function. The frequency gain transfer function is shown in a diagram with an abscissa (x-axis) designating frequencies, F, and an ordinate (y-axis) designating gain. The first filter 150; 250 described above has a characteristic with one or more first passbands 303; 304; 305 at one or more integer multiples of the first frequency value f1. The one or more first passbands includes an uppermost first passband 305, which is located at a higher frequency than the other first passbands 303; 304. These first passbands passes components of voiced speech having a fundamental frequency at a lowermost first passband 303. It is shown that the first filter has three first passbands, however the first filter may have one, two, four, five or a higher number of first passbands.

The one or more first passbands 303; 304; 305 are each separated by a first stop band. Thus, one or more first stop bands 306;307; 308 are located adjacent the one or more first passbands.

At least in some embodiments, but not necessarily in all embodiments, the first filter has a second passband 311 at or above the upper passband 305. The second passband 311 lets frequencies above at least one harmonic of the voiced speech signal pass through. The second passband may extend up to or beyond 5-20 Khz. The second passband may have a lower cut-off frequency at fn1 at least when the first filter includes the one or more first passbands. The lower cut-off frequency at fn1 may be located at or above the uppermost first passband 305; in some examples at one or more harmonic frequencies above the uppermost first passband.

The uppermost first passband 305 may be located below 500 Hz or below a lower or higher frequency. As an illustrative example, the transfer function of the first filter, or at least a portion thereof, including the first passbands and the second passband is shown in FIG. 4 and is designated by reference numeral 402—and in another example designated by reference numeral 403.

Also shown is an example of a transfer function 310 of a beamformer with a low frequency roll-off. The transfer function 310 may roll off at a corner frequency, fbf. Also shown is a transfer function 309 of an equalizer configured to compensate for the low frequency roll-off of the beamformer. The equalizer may have a transfer function that compensates for the low frequency roll-off of the beamformer.

In some embodiments the first filter has respective gains G1; G2; G3 at the one or more first passbands 306; 307;308 at the one or more integer multiples of the first frequency value; wherein the respective gains compensate for the low frequency roll-off of the beamformer. This is illustrated in FIG. 4 by transfer function 403 (dashed curve). Thereby the first filter is enabled to perform at least some frequency spectrum equalization. In some examples, the respective gains are computed as a function of a respective integer multiple of the first frequency value and a transfer function of the beamformer.

Figure 4:
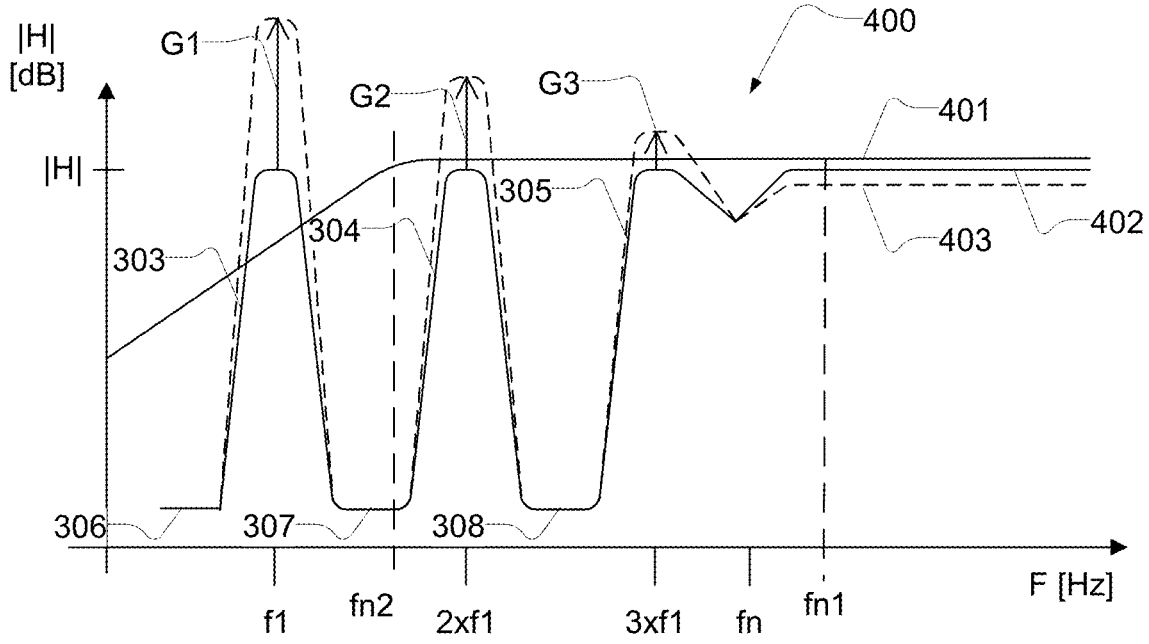
FIG. 4 shows a second example of an illustrative frequency gain characteristic.

FIG. 4 shows a second example of an illustrative frequency gain transfer function. In this example it is further shown that the first filter may be (re-)configured with a second passband 401 that is different from the second passband 311 shown above. In particular it can be seen that the lower cut-off frequency of the second passband is changed from a frequency fn1 to another frequency fn2. Frequency fn2 may be at a lower or higher frequency than fn1.

In some embodiments, in accordance with detecting absence of voiced speech, the first filter 150; 250 may be reconfigured, including dispensing with at least one of the one or more first stop bands. Then, the first filter may be further reconfigured including setting a lower cut-off frequency of the second passband at a predetermined lower cut-off frequency value, fn2. As shown the second passband 311; 401 may be a high-pass band.

Figure 5:
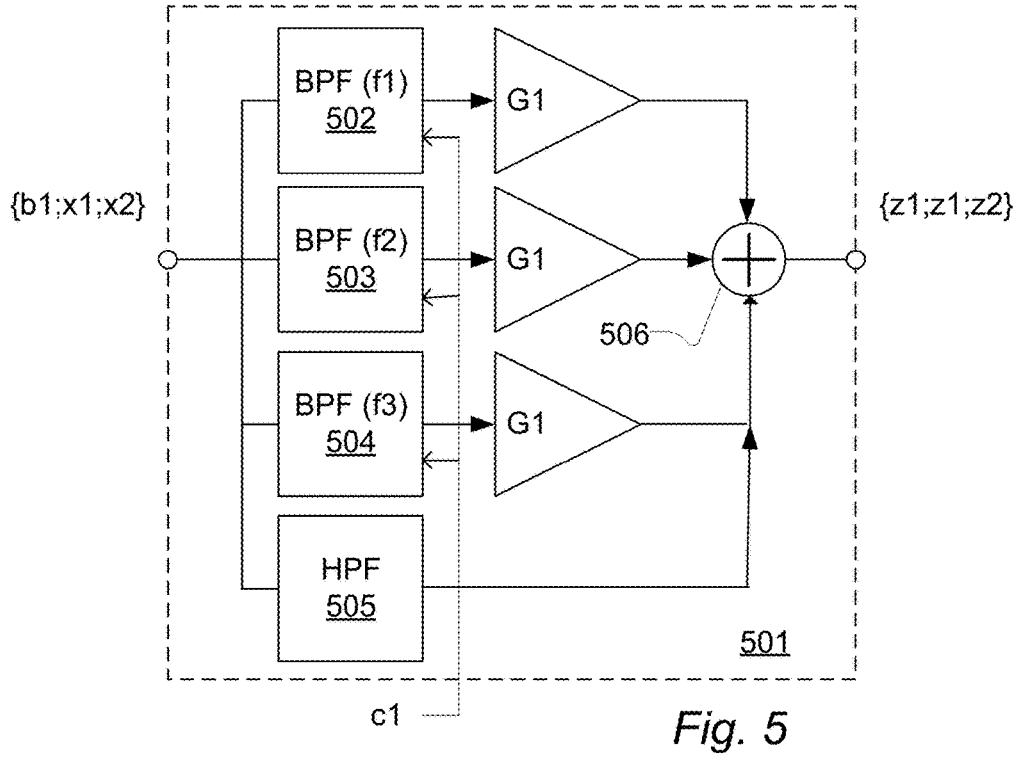
FIG. 5 shows a first embodiment of the first filter.

FIG. 5 shows a first embodiment of the first filter. In this embodiment, the first filter comprises parallel filter sections each dedicated to respective passbands. Inputs {b1;x1;x2} and outputs {b1;x1;x2} refer to the above reference numerals e.g. in FIGS. 1 and 2.

The first filter section 502 may be a band-pass filter with a passband at the fundamental frequency f1. Correspondingly, the second filter section 503 and the third filter section 504 may be band-pass filters with a passband at two and three times the fundamental frequency f1, respectively, i.e. at 2×f1 and 3×f1.

The first filter also comprises a fourth filter section, 505, dedicated to the second passband, which may be a high-pass band.

In this embodiment the filter sections, e.g. related to the first passbands, may be followed by gain stages G1, G2 and G3, respectively. The gain stages may provide frequency equalization as described above. Signals from the parallel filter sections are added or otherwise mixed by mixer 506.

Figure 6:
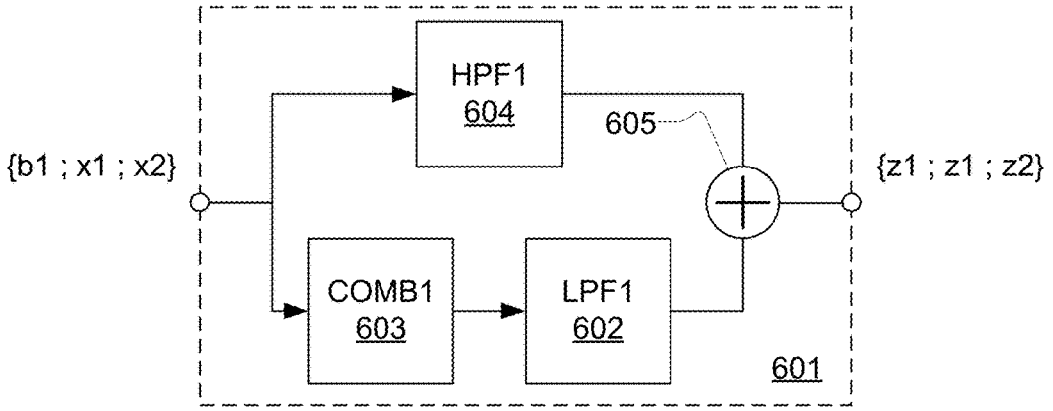
FIG. 6 shows a second embodiment of the first filter.

FIG. 6 shows a second embodiment of the first filter. This embodiment of the first filter 601 may be used in connection with an implementation of the first filter using a comb filter 603. Here, in a first parallel filter section, the comb filter is band-limited by means of a low-pass filter 602. The low-pass filter 602 may thus determine an uppermost first passband of the first filter. In particular an upper cut-off frequency of the low-pass filter 602 may determine an uppermost first passband of the first filter since the output from the comb filter 603 is band limited. The order of the comb filter and the low-pass filter may be interchanged. In a second parallel filter section, a high-pass filter 604 passes at least some frequencies above the uppermost first passband. Signals from the parallel filter sections are added or otherwise mixed by mixer 605.

Figure 7:
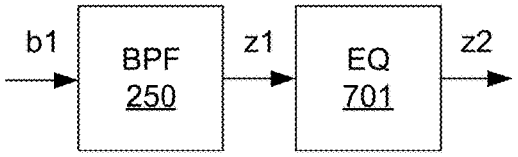
FIG. 7 shows a first embodiment including an equalizer.

FIG. 7 shows a first embodiment including an equalizer. In this embodiment an equalizer 701 follows the first filter 250. Output, z2, from the equalizer may be used as signal z1 in the embodiment shown in FIG. 2.

Figure 8:
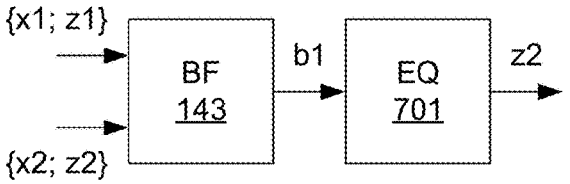
FIG. 8 shows a second embodiment including an equalizer.

FIG. 8 shows a second embodiment including an equalizer. In this embodiment the equalizer 701 follows the beamformer 143 e.g. in accordance with FIG. 1. Thus, the equalizer receives the beamformed signal b1. Output, z2, from the equalizer 701 may be used as signal b1 in the embodiment shown in FIG. 1.

Figure 9:
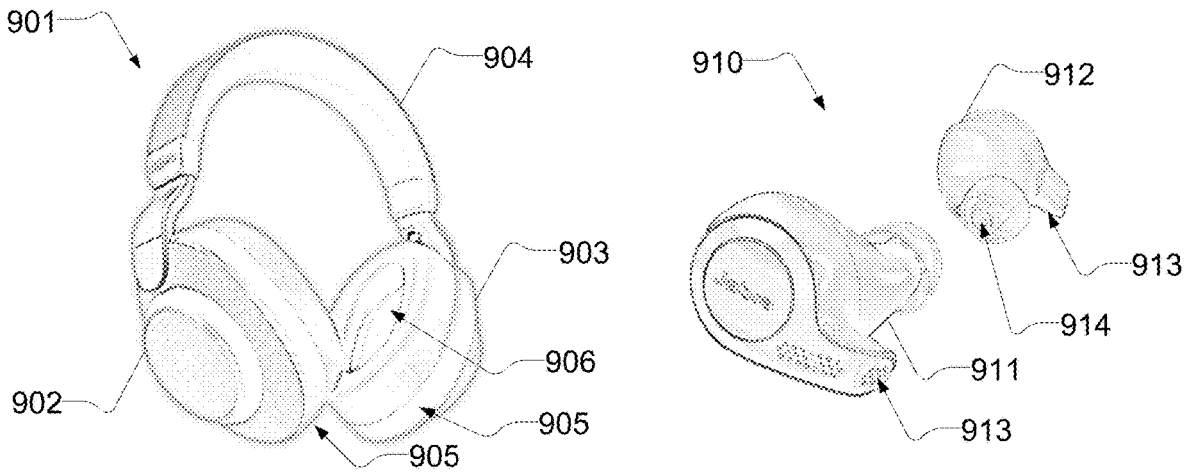
FIG. 9 shows a wearable electronic device embodied as a pair of headphones or as a pair of earphones.

FIG. 9 shows a wearable electronic device embodied as a pair of headphones or as a pair of earphones. The pair of headphones 901 comprises a headband 904 carrying a left earpiece 902 and a right earpiece 903 which may also be designated earcups. The pair of earphones 910 comprises a left earpiece 911 and a right earpiece 912.

The earpieces comprise at least one electro-mechanical output transducer, e.g. a loudspeaker, in each earpiece. The earpieces also comprise at least a first electro-mechanical input transducer and a second electro-mechanical input transducer, e.g. in the form of microphones. The earpieces may also comprise the third electro-mechanical input transducer e.g. in the form a microphone.

For the headphones 901, the first electro-mechanical input transducer and the second electro-mechanical input transducer may be arranged pairwise e.g. at a rim 905 of one or both of the earpieces 902 and 903 e.g. as outside microphones to pick up a first acoustic signal predominantly from an ambient space surrounding the earpiece. The third electro-mechanical input transducer may be arranged to pick up a second acoustic signal predominantly from an enclosed space 906 established between the earpiece and the user.

For the pair of earphones 910, the first electro-mechanical input transducer and the second electro-mechanical input transducer may be arranged pairwise e.g. at a protrusion 913 of one or both of the earpieces 911 and 912 e.g. as outside microphones to pick up a first acoustic signal predominantly from an ambient space surrounding of the earpiece. The third electro-mechanical input transducer may be arranged to pick up the second acoustic signal predominantly from an enclosed space 914 established between the earpiece and the user.

The headphone or pair of earphones may include a processing module.

Figure 10:
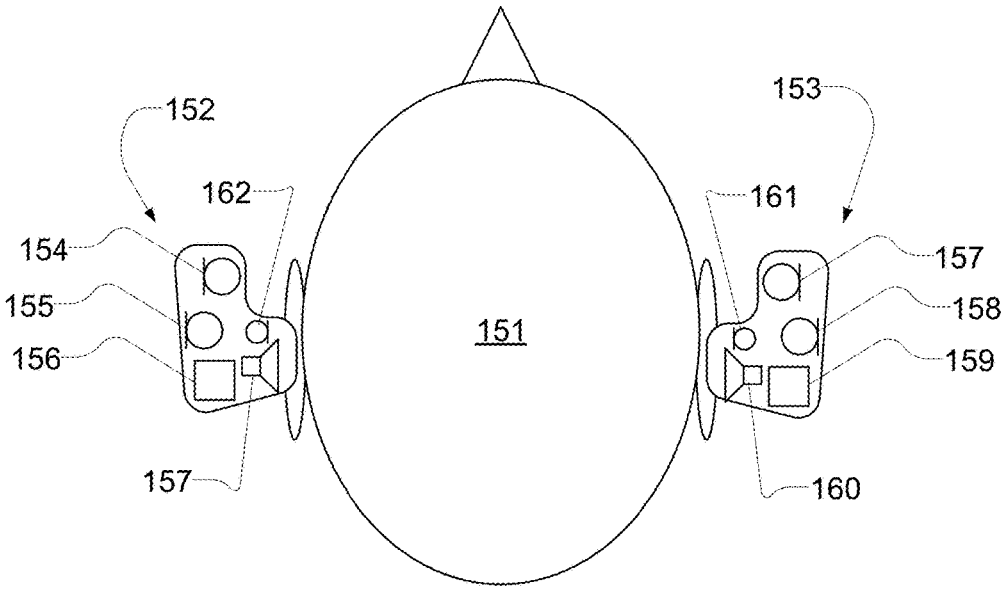
FIG. 10 shows a wearable electronic device configured as a headset or a hearing instrument.

FIG. 10 shows a wearable electronic device configured as a headset or a hearing instrument. There is shown a top-view of a person's head 151 in connection with a headset left device 152 and a headset right device 153. The headset left device 152 and the headset right device 153 may be in wired or wireless communication as it is known in the art.

The headset left device 152 comprises first and second microphones 154, 155, a miniature loudspeaker 157 and a processor 156. Additionally, the headset left device 152 comprises a third microphone 162. Correspondingly, the headset right device 13 comprises microphones 157, 158, a miniature loudspeaker 160 and a processor 159. Additionally, the headset right device 153 comprises a third microphone 161.

The microphones 154, 155 may be arranged in an array of microphones comprising further microphones e.g. one, two, or three further microphones. Correspondingly, microphones 157, 158 may be arranged in an array of microphones comprising further microphones e.g. one, two, or three further microphones. The further microphones may be input to beamforming.

The invention claimed is:

1. A method comprising:

at a wearable electronic device capable of detecting a voiced speech component, the device having: a first electro-acoustic input transducer and a second electro-acoustic input transducer arranged to pick up a first acoustic signal and convert the first acoustic signal to a first microphone signal and a second microphone signal; and a third electro-acoustic input transducer arranged to pick up a second acoustic signal and convert the second acoustic signal to a third microphone signal; and a processor:

generating a beamformed signal based on the first microphone signal and the second microphone signal;

estimating a first frequency value representing a fundamental frequency of a voiced speech component in one or more of: the first microphone signal, the second microphone signal and the third microphone signal;

configuring a first filter with one or more first passbands, including an upper first passband, at one or more integer multiples of the first frequency value; and one or more first stop bands adjacent the one or more passbands; wherein the first filter has a second passband above the upper passband;

filtering, using the first filter, one or more of: the first microphone signal, the second microphone signal and the beamformed signal.

2. A method according to claim 1, wherein the first electro-acoustic input transducer and the second electro-acoustic input transducer are arranged to pick up the first acoustic signal from an ambient space; and wherein the third electro-acoustic input transducer is arranged to pick up the second acoustic signal from an enclosed space different from the ambient space; and wherein the first frequency value is estimated based on the third microphone signal.

3. A method according to claim 1, comprising:

detecting periods with presence of voiced speech and periods with absence of voiced speech in one or more of: the first microphone signal, the second microphone signal and the third microphone signal;

in accordance with detecting presence of voiced speech, estimating the first frequency value based on a period with presence of voiced speech.

4. A method according to claim 1, comprising:

detecting periods with presence of voiced speech and periods with absence of voiced speech in one or more of: the first microphone signal, the second microphone signal and the third microphone signal;

in accordance with detecting absence of voiced speech, reconfiguring the first filter, including dispensing with at least one of the one or more first stop bands.

5. A method comprising:

at a wearable electronic device with: a first electro-acoustic input transducer and a second electro-acoustic input transducer arranged to pick up a first acoustic signal and convert the first acoustic signal to a first microphone signal and a second microphone signal; and a third electro-acoustic input transducer arranged to pick up a second acoustic signal and convert the second acoustic signal to a third microphone signal; and a processor:

generating a beamformed signal based on the first microphone signal and the second microphone signal;

estimating a first frequency value representing a fundamental frequency in one or more of: the first microphone signal, the second microphone signal and the third microphone signal;

configuring a first filter with one or more first passbands, including an upper first passband, at one or more integer multiples of the first frequency value; and one or more first stop bands adjacent the one or more passbands; wherein the first filter has a second passband above the upper passband;

filtering, using the first filter, one or more of: the first microphone signal, the second microphone signal and the beamformed signal and wherein the second passband is implemented by a high-pass filter with a lower cut-off frequency; comprising:

detecting periods with presence of voiced speech and periods with absence of voiced speech in one or more of: the first microphone signal, the second microphone signal and the third microphone signal;

in accordance with determining absence of voiced speech, reconfiguring the first filter, including setting a lower cut-off frequency of the high-pass filter at a predetermined lower cut-off frequency value.

6. A method according to claim 1, comprising:

performing frequency spectrum equalization, using a second filter, to compensate for a low-frequency roll-off, of the beamformer.

7. A method according to claim 1, wherein the first filter has respective gains at the one or more passbands at the one or more integer multiples of the first frequency value; wherein the respective gains compensate for a low frequency roll-off, of the beamformer.

8. A method according to claim 1, wherein the first filter comprises a comb filter.

9. A method according to claim 1, wherein the upper first passband is located at a first integer multiple of the first frequency value; and wherein the first integer multiple is determined based on one or both of: a predetermined integer value and a value based on one or more of: the first microphone signal, the second microphone signal and the third microphone signal.

10. A method according to claim 1, comprising:

transmitting a signal which is based on the beamformed signal to a remote electronic device.

11. A method according to claim 1, wherein the wearable electronic device comprises a first electro-acoustic output transducer arranged to emit an acoustic signal at an enclosed space established by at least a portion of the wearable electronic device at a wearer's ear.

12. A method according to claim 1, comprising:

performing active noise cancellation based on a feedback signal, which is based on the third microphone signal; wherein an active noise cancellation signal is emitted by the first electro-mechanical output transducer.

13. A method according to claim 1, comprising:

performing short term Fourier transform of one or more of: the first microphone signal, the second microphone signal, the third microphone signal, the first microphone signal when filtered using the first filter, the second microphone signal when filtered using the first filter; and performing inverse short term Fourier transform of a signal based on the beamformed signal;

wherein one or more of the first filtering, the second filtering, equalization and beamforming is performed in the frequency domain.

14. A wearable electronic device comprising:

a first electro-acoustic input transducer and a second electro-acoustic input transducer arranged to pick up a first acoustic signal and convert the first acoustic signal to a first microphone signal and second microphone signal;

a third electro-acoustic input transducer arranged to pick up a second acoustic signal and convert the second acoustic signal to a third microphone signal; and a processor configured to generate a beamformed signal based on the first microphone signal and the second microphone signal;

estimate a first frequency value representing a fundamental frequency in one or more of: the first microphone signal, the second microphone signal and the third microphone signal;

configure a first filter with one or more first passbands, including an upper first passband, at one or more integer multiples of the first frequency value; and one or more first stop bands adjacent the one or more passbands; wherein the first filter has a second passband above the upper passband;

filter, using the first filter, one or more of: the first microphone signal, the second microphone signal and the beamformed signal and wherein the second passband is implemented by a high-pass filter with a lower cut-off frequency; and detecting periods with presence of voiced speech and periods with absence of voiced speech in one or more of: the first microphone signal, the second microphone signal and the third microphone signal;

in accordance with determining absence of voiced speech, reconfiguring the first filter, including setting a lower cut-off frequency of the high-pass filter at a predetermined lower cut-off frequency value.

15. A signal processing module for a headphone, an earphone or a headset; wherein the signal processing module is configured to perform the method according to claim 14.

* * * * *